US006387064B1

(12) United States Patent
Gunnon

(10) Patent No.: US 6,387,064 B1
(45) Date of Patent: May 14, 2002

(54) FOOT PUMP POWERED NECK MASSAGING DEVICE

(76) Inventor: Brent Gunnon, 4625 74th St. SW., Mukilteo, WA (US) 98275

( * ) Notice: Subject to any disclaimer, the term of this patent is extended or adjusted under 35 U.S.C. 154(b) by 0 days.

(21) Appl. No.: 09/933,432

(22) Filed: Aug. 20, 2001

(51) Int. Cl.[7] ..... A61H 19/00
(52) U.S. Cl. ..... 601/148; 601/149; 601/84
(58) Field of Search ..... 128/20, 26; 602/13; 601/149, 150, 152

(56) References Cited

U.S. PATENT DOCUMENTS 1,795,893 A 3/1931 Rosett
4,372,297 A 2/1983 Perlin ..... 128/64
5,374,238 A 12/1994 Xiao ..... 601/57
5,711,760 A * 1/1998 Ibrahim et al. ..... 601/149

FOREIGN PATENT DOCUMENTS

FR 39629 * 11/1981

* cited by examiner

*Primary Examiner*—Jeanette Chapman
*Assistant Examiner*—Fenn Mathew
(74) *Attorney, Agent, or Firm*—Goldstein Law Offices, P.C.

(57) ABSTRACT

A foot pump powered neck massaging device including an first bladder and a second bladder securable to a lower surface of a shoe worn by a user. The first bladder and the second bladder each have an air outlet. A massaging hand is in communication with the first bladder and the second bladder. The massaging hand is comprised of pliable fingers. The pliable fingers are conformable around the user's neck.

5 Claims, 5 Drawing Sheets

FOOT PUMP POWERED NECK MASSAGING DEVICE

BACKGROUND OF THE INVENTION

The present invention relates to a foot pump powered neck massaging device and more particularly pertains to providing a soothing neck massage while a person is walking.

The use of massaging devices is known in the prior art. More specifically, massaging devices heretofore devised and utilized for the purpose of providing massages are known to consist basically of familiar, expected and obvious structural configurations, notwithstanding the myriad of designs encompassed by the crowded prior art that have been developed for the fulfillment of countless objectives and requirements.

By way of example, U.S. Pat. No. 4,372,297 to Perlin discloses an inflatable chamber device for applying compression about a patient's limb capable of using a foot activated pump. U.S. Pat. No. 1,795,893 to Rosett discloses a therapeutic device comprised of a helmet capable of providing a massaging action to such areas of the body as the neck. U.S. Pat. No. 5,374,238 to Xiao discloses a vibrating neck rest.

While these devices fulfill their respective, particular objective and requirements, the aforementioned patents do not describe a foot pump powered neck massaging device for providing a soothing neck massage while a person is walking.

In this respect, the foot pump powered neck massaging device according to the present invention substantially departs from the conventional concepts and designs of the prior art, and in doing so provides an apparatus primarily developed for the purpose of providing a soothing neck massage while a person is walking.

Therefore, it can be appreciated that there exists a continuing need for a new and improved foot pump powered neck massaging device that can be used for providing a soothing neck massage while a person is walking. In this regard, the present invention substantially fulfills this need.

SUMMARY OF THE INVENTION

In the view of the foregoing disadvantages inherent in the known types of massaging devices now present in the prior art, the present invention provides an improved foot pump powered neck massaging device. As such, the general purpose of the present invention, which will be described subsequently in greater detail, is to provide a new and improved foot pump powered neck massaging device that has all the advantages of the prior art and none of the disadvantages.

To attain this, the present invention essentially comprises an first bladder securable to a lower surface of a right shoe worn by a user. The first bladder includes a first section and a second section. The first section is disposed under a heel of the right shoe. The second section is disposed under a toe of the right shoe. The first and second section each have an air outlet. A second bladder is securable to a lower surface of a left shoe worn by a user. The second bladder includes a first section and a second section. The first section is disposed under a heel of the left shoe. The second section is disposed under a toe of the left shoe. The first and second section each have an air outlet. A massaging hand is in communication with the first bladder and the second bladder. The massaging hand comprises pliable fingers. The pliable fingers include a thumb, a forefinger, a middle finger, a ring finger, and a little finger. The massaging hand includes first and second central air conduit circuits. The forefinger, middle finger, ring finger, and little finger each have a front and a back central air cylinder coupled thereto. The central air cylinders of the forefinger and middle finger are in communication with the first central air conduit circuit. The central air cylinders of the ring finger and little finger are in communication with the second central air conduit. The massaging hand includes first and second air inlets in communication with the air outlets of the first and second sections of the first bladder. The massaging hand includes third and fourth inlets in communication with the air outlets of the first and second sections of the second bladder.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved foot pump powered neck massaging device that has all the advantages of the prior art massaging devices and none of the disadvantages.

It is another object of the present invention to provide a new and improved foot pump powered neck massaging device that may be easily and efficiently manufactured and marketed.

It is a further object of the present invention to provide a new and improved foot pump powered neck massaging device that is of durable and reliable construction.

An even further object of the present invention is to provide a new and improved foot pump powered neck massaging device that is susceptible of a low cost of manufacture with regard to both materials and labor, and which accordingly is then susceptible of low prices of sale to the consuming public, thereby making such a foot pump powered neck massaging device economically available to the buying public.

Even still another object of the present invention is to provide a new and improved foot pump powered neck massaging device for providing a soothing neck massage while a person is walking.

Lastly, it is an object of the present invention to provide a new and improved foot pump powered neck massaging device including an first bladder and a second bladder securable to a lower surface of a shoe worn by a user. The first bladder and the second bladder each have an air outlet. A massaging hand is in communication with the first bladder and the second bladder. The massaging hand comprises pliable fingers. The pliable fingers are conformable around the user's neck.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

With reference now to the drawings, and in particular, to figures one through nine thereof, the preferred embodiment of the new and improved foot pump powered neck massaging device embodying the principles and concepts of the present invention and generally designated by the reference number 10 will be described.

Specifically, it will be noted in the various figures that the device relates to a foot pump powered neck massaging device for providing a soothing neck massage while a person is walking. In its broadest context, the device consists of an first bladder, a second bladder, and a massaging hand. Such components are individually configured and correlated with respect to each other so as to attain the desired objective.

Figure 1:
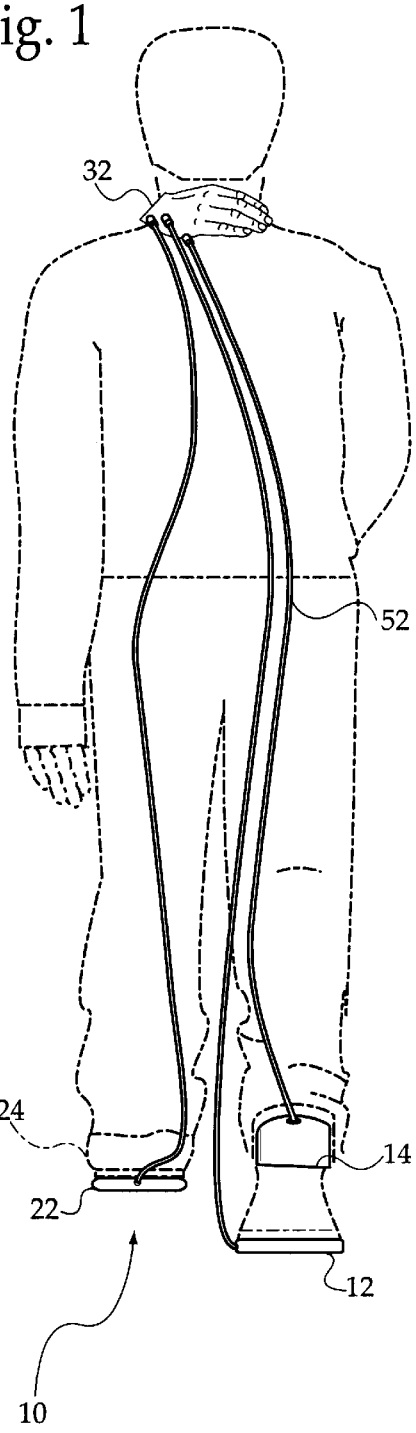
FIG. 1 is a perspective view of the preferred embodiment of the foot pump powered neck massaging device constructed in accordance with the principles of the present invention.
Figure 2:
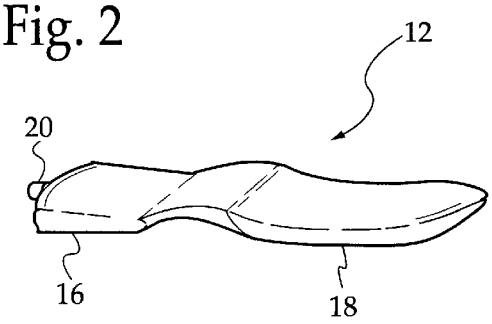
FIG. 2 is a perspective view of the bladder of the present invention.
Figure 3:
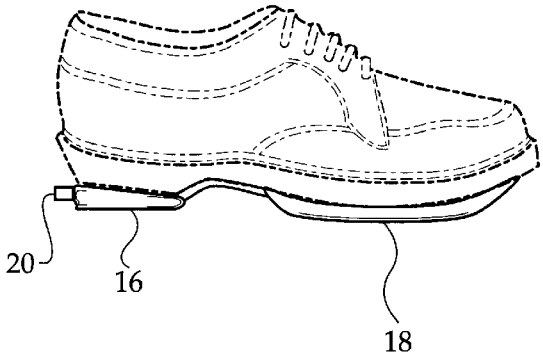
FIG. 3 is a perspective view of the bladder illustrated in place on a shoe.
Figure 4:
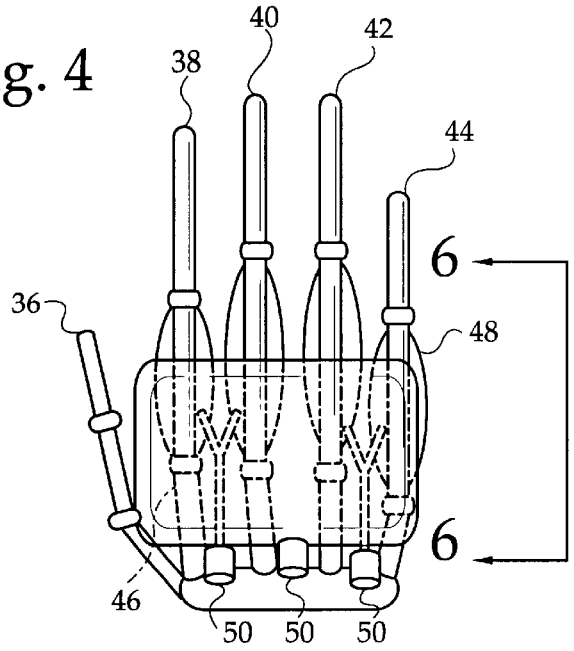
FIG. 4 is a plan view of the massaging hand of the present invention.
Figure 6:
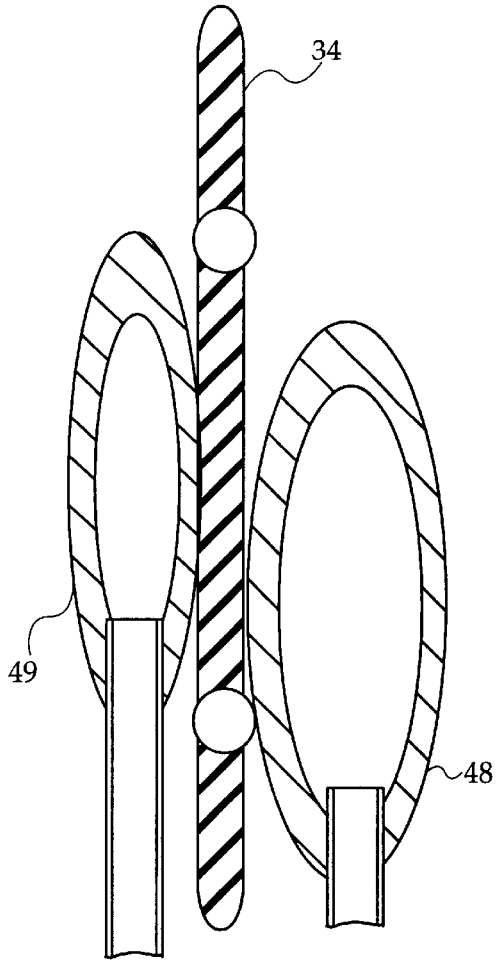
FIG. 6 is a cross-sectional side view of the present invention as taken along line 6—6 of FIG. 4.
Figure 5:
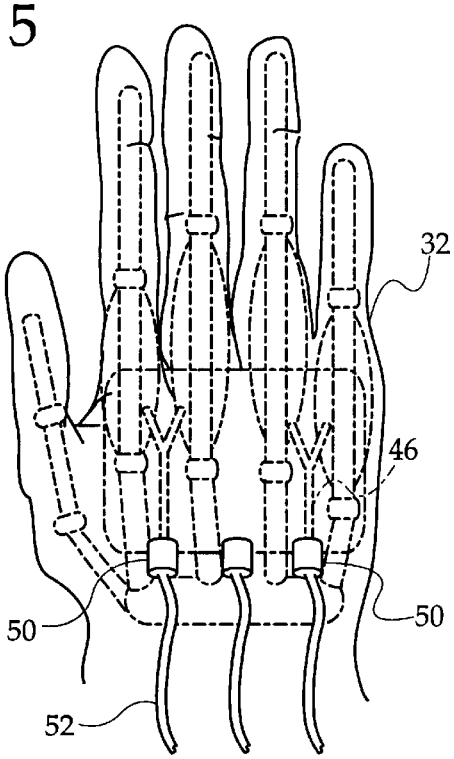
FIG. 5 is a cross-sectional plan view of the massaging hand of the present invention.

The first bladder 12 is securable to a lower surface of a right shoe 14 worn by a user. Note FIG. 1. The first bladder 12 includes a first section 16 and a second section 18. Note FIG. 2. The first section 16 is disposed under a heel of the right shoe 14. Note FIG. 3. The second section 18 is disposed under a toe of the right shoe 14. Note FIG. 3. The first and second section 16,18 each have an air outlet 20.

The second bladder 22 is securable to a lower surface of a left shoe 24 worn by a user. Note FIG. 1. The second bladder 22 includes a first section 26 and a second section 28. The first section 26 is disposed under a heel of the left shoe 24. The second section 28 is disposed under a toe of the left shoe 24. The first and second section 26,28 each have an air outlet 30.

Figure 9:
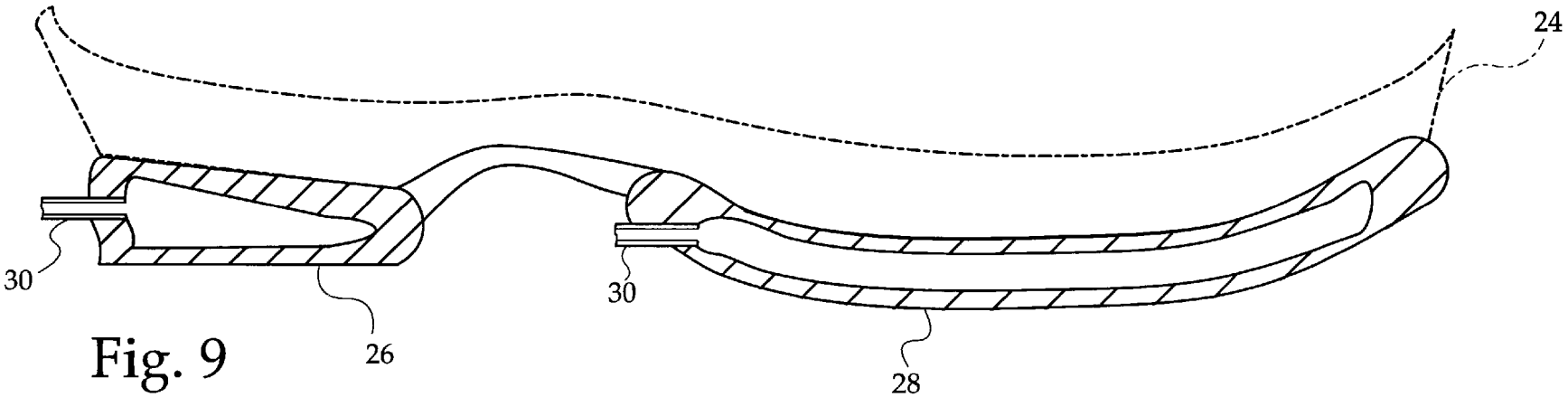
FIG. 9 is a cross-sectional side view of the bladder of the present invention.

The first bladder 12 and the second bladder 22 are essentially identical in physical characteristics. Note FIG. 9.

The massaging hand 32 is in communication with the first bladder 12 and the second bladder 22. The massaging hand 32 comprises pliable fingers 34. The pliable fingers 34 include a thumb 36, a forefinger 38, a middle finger 40, a ring finger 42, and a little finger 44. The massaging hand 32 includes first and second central air conduit circuits 46. The forefinger 38, middle finger 40, ring finger 42, and little finger 44 each have a front central air cylinder 48 and a back central air cylinder 49 coupled thereto. The central air cylinders 48,49 of the forefinger 38 and middle finger 40 are in communication with the first central air conduit circuit 46. The central air cylinders 48,49 of the ring finger 42 and little finger 44 are in communication with the second central air conduit 46. The massaging hand 32 includes first and second air inlets 50 in communication with the air outlets 20 of the first and second sections 16,18 of the first bladder 12. The massaging hand 32 includes third and fourth inlets 50 in communication with the air outlets 30 of the first and second sections 36,38 of the second bladder 22. The use of elongated and flexible conduits 52 will couple air outlets 20,30 with the first, second, third and fourth air inlets 50 of the massaging hand 32. The conduits 52 will transfer either water or air between the bladders 12,22 and the massaging hand 32.

Figure 7:
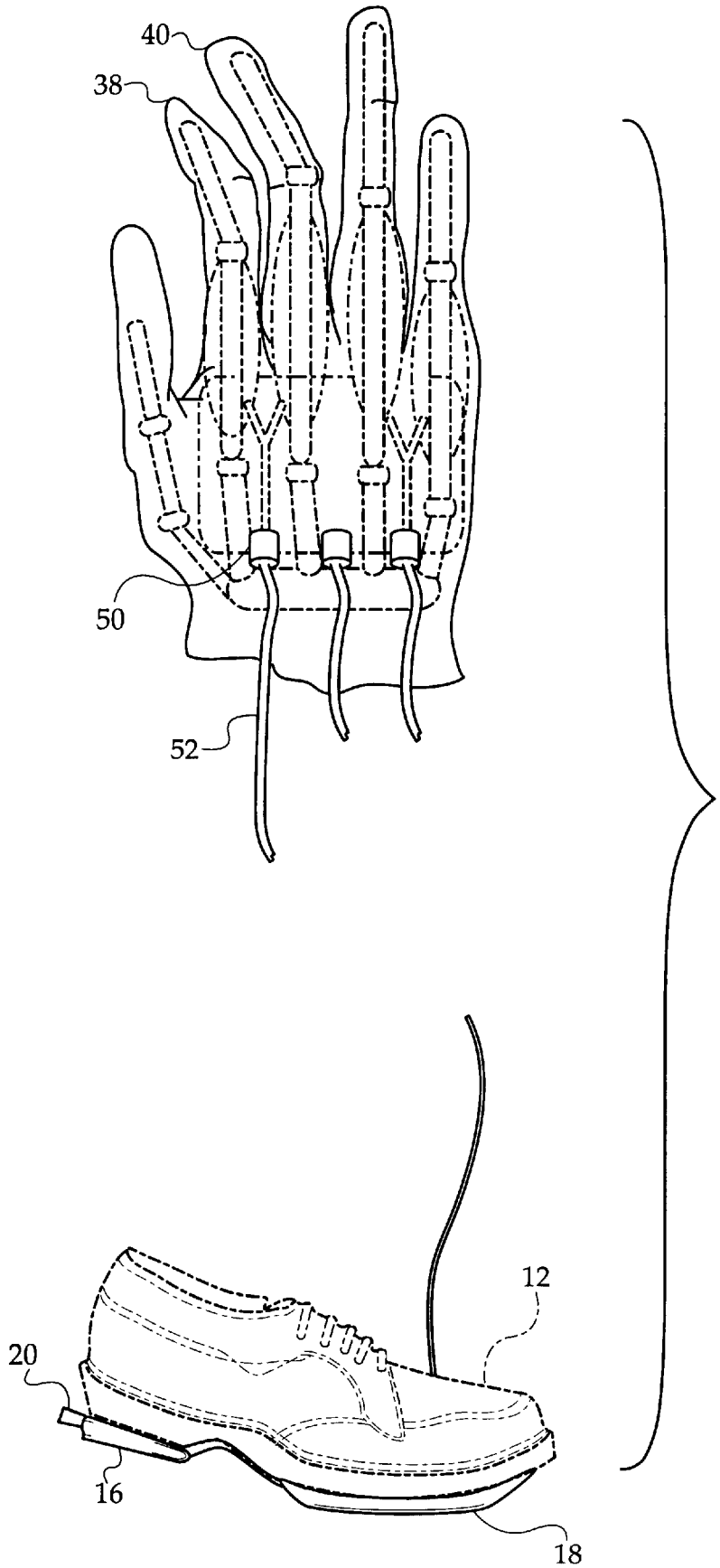
FIG. 7 is a cross-sectional plan view of the massaging hand illustrated with the forefinger and the middle finger in a contracted orientation.
Figure 8:
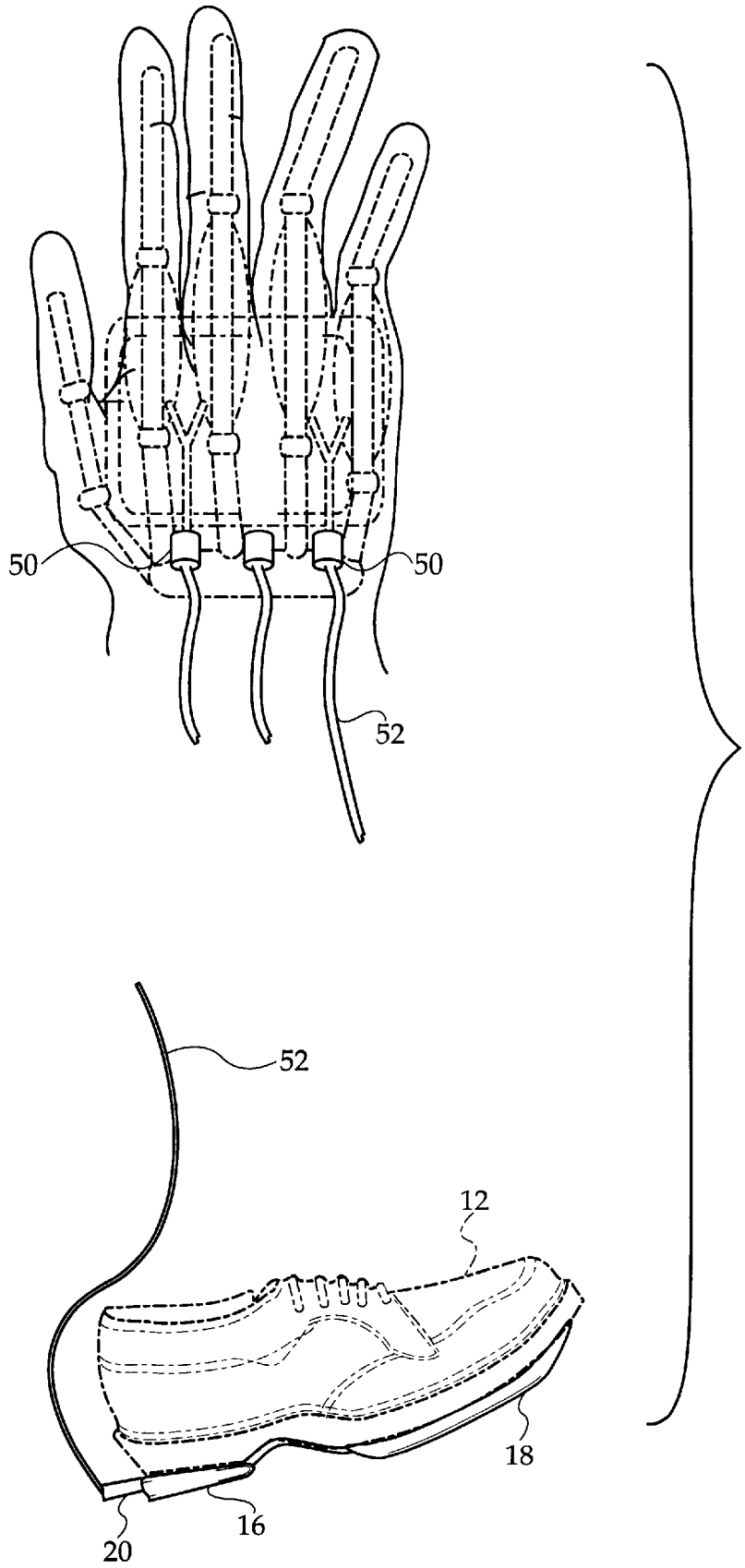
FIG. 8 is a cross-sectional plan view of the massaging hand illustrated with the ring finger and the little finger in a contracted orientation.

In use, the present invention will provide a massaging action to the user's neck while they are walking. When the user steps down on their right foot 14 in a heel to toe action, the massaging hand 32 will contract around the neck. Specifically, once the heel is first stepped on, the forefinger 38 and middle finger 40 will contract. Note FIG. 7. Once the toe is stepped on, the ring finger 42 and the little finger 44 will contract. Note FIG. 8. This is accomplished by the inflation of the back central air cylinders 49. When the user steps down on their left foot 24, the massaging hand 32 will retract from the neck. This is accomplished by the inflation of the front central air cylinders 48 which will cause the fingers to expand thereby releasing the neck. Additionally, the massaging hand 32 could be provided with a pressure release valve that can vary the massaging action of the hand 32 according to the amount of pressure applied to the first bladder 12 when walking or running. As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A foot pump powered neck massaging device for providing a soothing neck massage while a person is walking comprising, in combination:

an first bladder securable to a lower surface of a right shoe worn by a user, the first bladder including a first section and a second section, the first section being disposed under a heel of the right shoe, the second section being disposed under a toe of the right shoe, the first and second section each having an air outlet;

a second bladder securable to a lower surface of a left shoe worn by a user, the second bladder including a first section and a second section, the first section being disposed under a heel of the left shoe, the second section being disposed under a toe of the left shoe, the first and second section each having an air outlet; and a massaging hand in communication with the first bladder and the second bladder, the massaging hand being comprised of pliable fingers, the pliable fingers including a thumb, a forefinger, a middle finger, a ring finger, and a little finger, the massaging hand including first and second central air conduit circuits, the forefinger, middle finger, ring finger, and little finger each having a front and a back central air cylinder coupled thereto, the central air cylinders of the forefinger and middle finger being in communication with the first central air conduit circuit, the central air cylinders of the ring finger and little finger being in communication with the second central air conduit, the massaging hand including first and second air inlets in communication with the air outlets of the first and second sections of the first bladder, the massaging hand including third and fourth inlets in communication with the air outlets of the first and second sections of the second bladder.

2. A foot pump powered neck massaging device for providing a soothing neck massage while a person is walking comprising, in combination:

an first bladder and a second bladder securable to a lower surface of a shoe worn by a user, the first bladder and the second bladder each having an air outlet; and a massaging hand in communication with the air outlet of the first bladder and the second bladder, the massaging hand being comprised of pliable fingers, the pliable fingers being conformable around a person's neck.

3. The foot pump powered neck massaging device as set forth in claim 2, wherein the first bladder includes a first section and a second section, the first section being disposed under a heel of the right shoe, the second section being disposed under a toe of the right shoe.

4. The foot pump powered neck massaging device as set forth in claim 2, wherein the second bladder includes a first section and a second section, the first section being disposed under a heel of the left shoe, the second section being disposed under a toe of the left shoe.

5. The foot pump powered neck massaging device as set forth in claim 2, wherein the pliable fingers include a thumb, a forefinger, a middle finger, a ring finger, and a little finger, the massaging hand including first and second central air conduit circuits, the forefinger, middle finger, ring finger, and little finger each having a front and back central air cylinder coupled thereto, the front and back central air cylinders of the forefinger and middle finger being in communication with the first central air conduit circuit, the central air cylinders of the ring finger and little finger being in communication with the second central air conduit, the massaging hand including first and second air inlets in communication with the first bladder, the massaging hand including third and fourth inlets in communication with the first and second sections of the second bladder.

* * * * *